US006240709B1

(12) United States Patent
Cook

(10) Patent No.: US 6,240,709 B1
(45) Date of Patent: Jun. 5, 2001

(54) COLLAPSIBLE BAG FOR STACKING AND METHOD THEREOF

(75) Inventor: Norman John Cook, Smyrna, GA (US)

(73) Assignee: Linpac, Inc., Austell, GA (US)

( * ) Notice: Subject to any disclaimer, the term of this patent is extended or adjusted under 35 U.S.C. 154(b) by 0 days.

(21) Appl. No.: 09/357,213

(22) Filed: Jul. 20, 1999

(51) Int. Cl.[7] ..... B65B 7/00

(52) U.S. Cl. ..... 53/469; 53/473; 53/479; 53/481; 53/482

(58) Field of Search ..... 53/434, 436, 469, 53/473, 410, 479, 481, 482; 383/32, 39, 40, 44, 45, 46, 82, 88, 103

(56) References Cited

U.S. PATENT DOCUMENTS

| | | | | |
|---|---|---|---|---|
| 485,098 | * | 10/1892 | Forshew | 383/40 |
| 1,431,712 | * | 10/1922 | Weinstein | 53/482 |
| 2,093,978 | * | 9/1937 | Farmer | 383/32 |
| 2,292,295 | * | 8/1942 | Royal | 53/469 |
| 2,293,182 | | 8/1942 | Vogt . | |
| 3,469,364 | * | 9/1969 | Bishof | 53/469 |
| 3,673,758 | * | 7/1972 | Esty | 53/469 |
| 3,855,907 | * | 12/1974 | Johnson et al. | 53/469 |
| 3,949,901 | * | 4/1976 | Tokita | 383/40 |
| 4,162,602 | * | 7/1979 | Achelpohl et al. | 53/469 |
| 4,324,333 | | 4/1982 | Porter . | |
| 4,426,015 | | 1/1984 | Preston et al. . | |
| 4,499,599 | * | 2/1985 | Polett et al. | 383/32 |
| 4,786,192 | | 11/1988 | Graves et al. . | |
| 4,819,793 | * | 4/1989 | Willard et al. | 383/40 |
| 4,834,255 | | 5/1989 | Boots . | |
| 4,901,885 | | 2/1990 | Boots . | |
| 4,903,859 | | 2/1990 | Derby et al. . | |
| 4,909,410 | | 3/1990 | Derby et al. . | |
| 4,927,037 | | 5/1990 | Boots . | |
| 4,930,661 | | 6/1990 | Voorhies . | |
| 4,991,980 | * | 2/1991 | Cohen et al. | 383/40 |
| 5,046,860 | * | 9/1991 | Brennan | 383/39 |
| 5,071,025 | | 12/1991 | Boots . | |
| 5,282,544 | | 2/1994 | Boots . | |
| 5,348,400 | * | 9/1994 | Haiss et al. | 383/82 |

OTHER PUBLICATIONS

Advertisement (undated) for Pli–Valv Pressure Relief Valves of Plitek, LLC.

* cited by examiner

*Primary Examiner*—Peter Vo
*Assistant Examiner*—Louis K. Huynh
(74) *Attorney, Agent, or Firm*—Finnegan, Henderson, Farabow, Garrett & Dunner, L.L.P.

(57) ABSTRACT

A collapsible bag which is adapted to have another bag stacked thereon when the collapsible bag is filled with material. The collapsible bag includes a main body, a bottom portion, and a top portion. The main body defines a plurality of vertical sections to provide columnar support for holding the bag upright when the vertical sections are substantially filled with material. The bottom portion depends from the main body and includes at least one bottom seal for closing the bottom portion, wherein the bottom portion defines a substantially planar base. The top portion extends from the main body at an end opposite the bottom portion. The top portion includes a top seal for closing the top portion. The top portion defines an interior space within the bag between the top seal and an imaginary fill line. The top portion also includes a vent between the top seal and the fill line, whereby air within the interior space is vented to the atmosphere in response to downward pressure on the top portion to collapse the bag onto its contents. A substantially planar top surface is formed along the fill line to facilitate stacking the bag.

3 Claims, 5 Drawing Sheets

COLLAPSIBLE BAG FOR STACKING AND METHOD THEREOF

BACKGROUND OF THE INVENTION

1. Field of the Invention

The present invention generally relates to collapsible and stackable bags and methods for stacking collapsible bags. More particularly, the invention relates to collapsible bags which are capable of being stacked when filled and methods of forming the bags to facilitate stacking.

2. Description of the Related Art

Bags capable of standing substantially upright are generally known in the art. For example, U.S. Pat. No. 4,934,255 to Boots, which is incorporated by reference herein, discloses flexible containers made of plastic film comprising a tubular outer envelope and an inner member affixed to the outer envelope. The inner member, which is at least 30% of the height of the outer envelope, provides outer spaces between the inner member and the outer envelope that are in open communication with an interior space within the inner member. As a result, material deposited in the containers described in the Boots patent fills the inner and outer spaces. This construction enables the inner and outer spaces to function like columns so that the bags stand substantially upright when filled.

Typically, when conventional bags of the Boots construction are filled and closed, air is captured in the top of the bag. The entrained air prevents the top of the conventional bag from collapsing onto the contents of the bag to provide a level surface for stacking.

SUMMARY OF THE INVENTION

To overcome the disadvantages of the prior art, and in accordance with the purposes of the invention, as embodied and broadly described herein, there is provided a collapsible bag adapted to be stacked on another such bag when filled with material. The collapsible bag comprises a main body, a bottom portion, and a top portion.

In accordance with the present invention, the main body is provided for retaining material deposited into the bag. The main body includes vertical sections to provide columnar support for holding the bag upright when the vertical sections are substantially filled with material.

The collapsible bag of the present invention also includes a bottom portion depending from the main body. The bottom portion contains at least one bottom seal for closing the bottom portion, such that the bottom portion is adapted to provide a substantially planar base along the outside of the bag.

The collapsible bag of the present invention further includes a top portion extending from the main body at an end opposite the bottom portion. The top portion includes a top seal for closing the top portion. The top portion defines an interior space within the bag between the top seal and an imaginary fill line. The top portion also includes a vent between the top seal and the fill line, whereby air within the interior space is vented to the atmosphere in response to downward pressure on the top portion collapsing the bag onto its contents, so that a substantially planar top surface is formed substantially along the fill line to facilitate stacking. Preferably the vent is a one-way valve to allow air to exit the bag, while precluding air from entering the bag.

The present invention further includes a method of forming a collapsible bag for stacking, wherein the collapsible bag includes a main body having an interior wall and an outer wall. The interior wall is integrally connected to the outer wall and defines a plurality of vertical sections. The bag also includes a closed bottom portion connected to the main body and having a substantially planar base. The bag further includes a top portion extending from the main body at an end opposite the bottom portion.

In accordance with the present invention, the method comprises the steps of filling the vertical sections with sufficient material to provide columnar support for holding the bag upright thereby defining a fill line; sealing the top portion of the bag, so that an interior space is provided within the bag between the top seal and the fill line; providing a vent to the top portion between the top seal and the fill line; after the sealing step, compressing the top portion of the bag and venting the interior space to provide a substantially planar top surface along the fill line; and stacking another bag on the top surface of the bag.

BRIEF DESCRIPTION OF THE DRAWINGS

The accompanying drawings, which are incorporated in and constitute part of the specification, illustrate a presently preferred embodiment of the invention and, together with the general description given above and detailed description of the preferred embodiment given below, serve to explain the principles of the invention.

DESCRIPTION OF THE PREFERRED EMBODIMENTS

Reference will now be made in detail to present preferred embodiments of the invention, as generally illustrated in the accompanying drawings.

In accordance with the present invention, a collapsible bag or package is adapted to be stacked on another bag, preferably of like configuration, when filled with material. The bag of the present invention has a wide range of applications. In that respect, the material contemplated for use with the bag may include dry or liquid goods. The dry goods may be granular substances, such as bird seed, detergent, kitty lifter, and minerals like rock salt. The bag also may be suitable for food products such as cereal or candy. This list is merely exemplary, as those skilled in this field will immediately appreciate a whole host of different materials suitable as contents for the collapsible, and stackable, packaging of the present invention.

Figure 1:
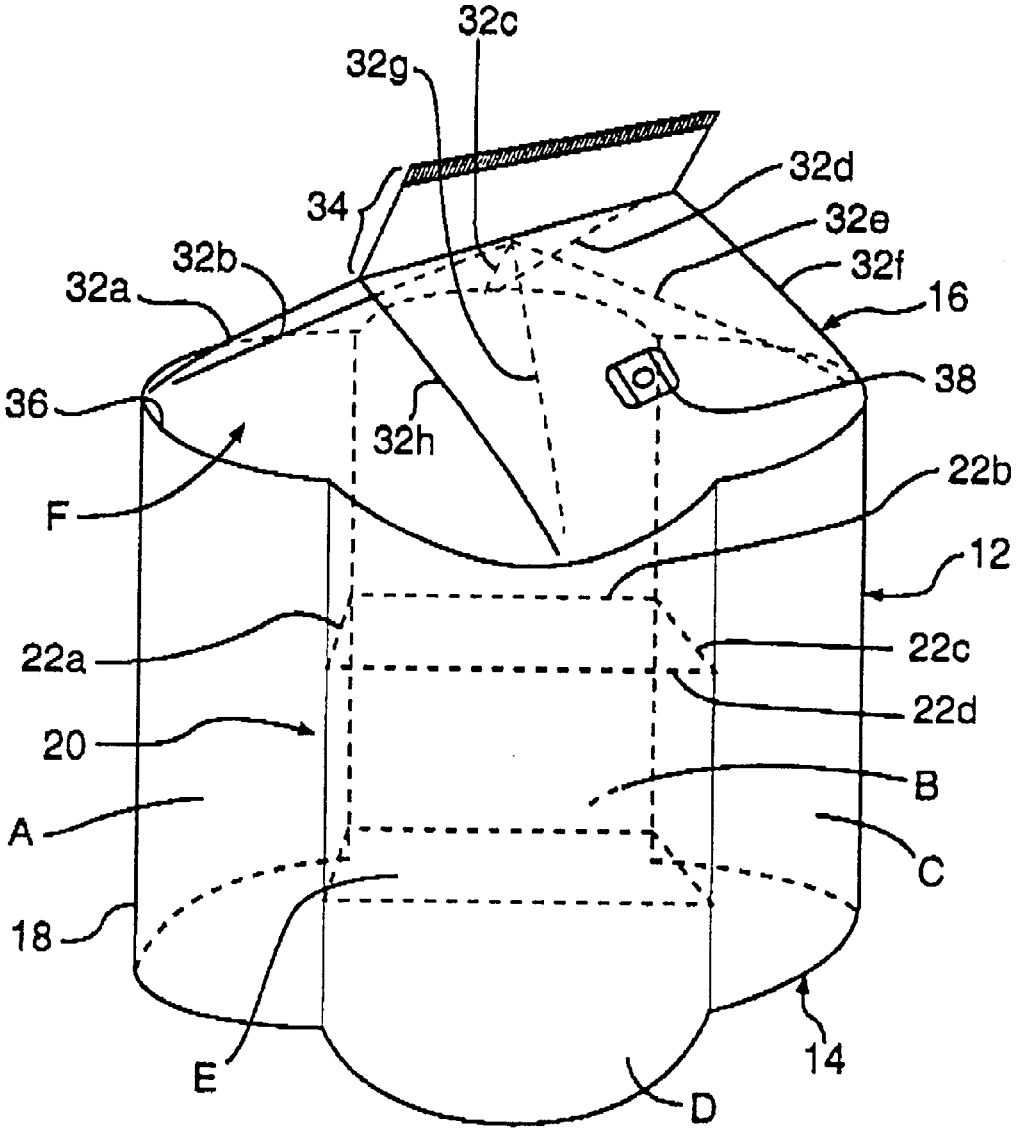
FIG. 1 is a perspective view of the collapsible bag of the present invention.
Figure 2:
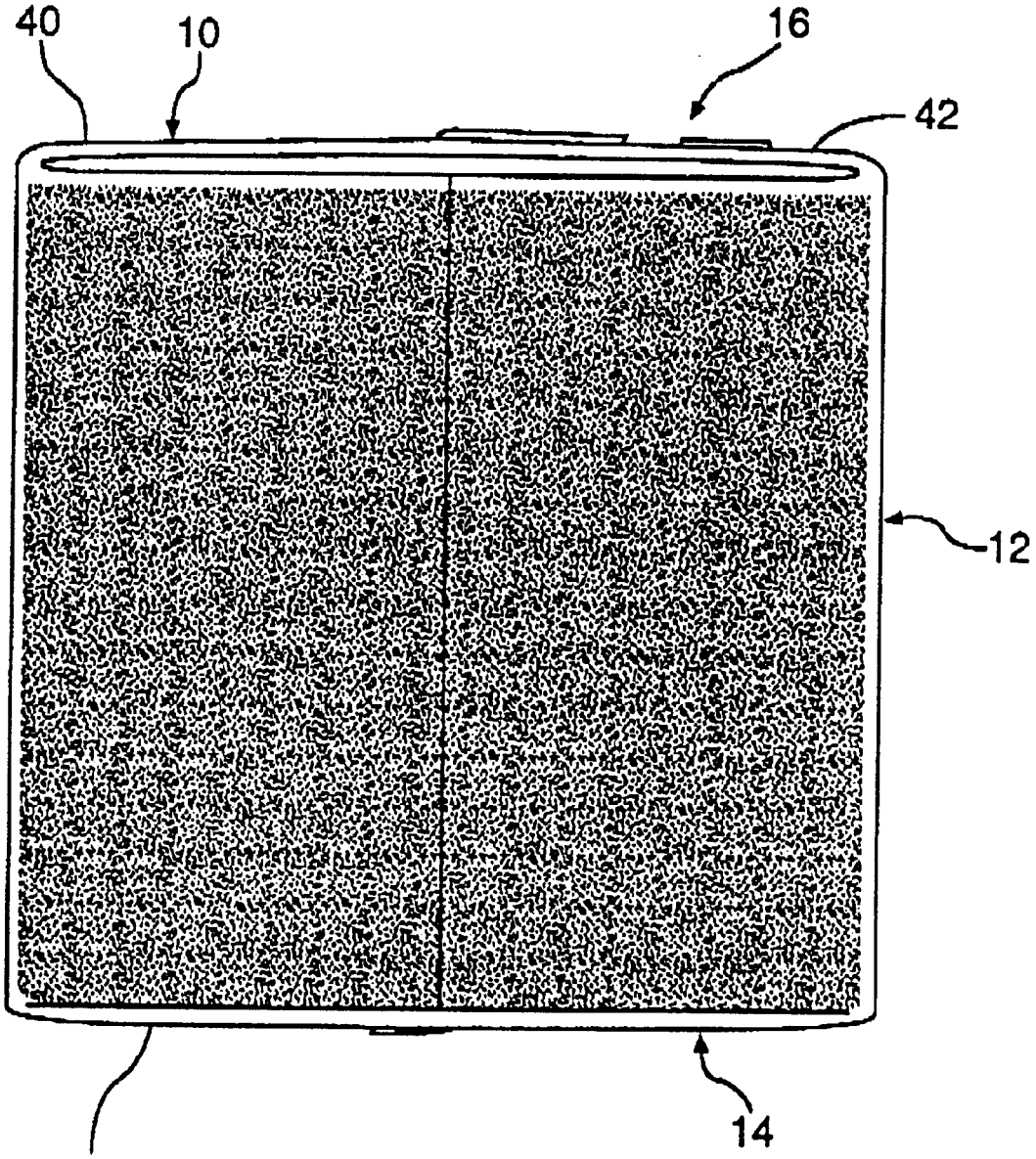
FIG. 2 is a side view of the collapsible bag in FIG. 1 with material shown therein, in which the top of the bag has been vented, collapsed folded to form a substantially planar surface.

As embodied herein and shown in FIGS. 1 and 2, the collapsible bag 10 includes a main body 12, a bottom portion 14, and a top portion 16. The main body 12 retains material deposited into the bag 10 when the bottom portion 14 is closed. The main body 12 includes an outer wall 18 and an interior wall, which is generally designated by reference numeral 20. Preferably, the bag is formed from plastic material; however, paper or a paper and plastic composite may be suitable for many applications.

As shown in FIG. 1, the interior wall 20 may include a single sheet of plastic or paper attached at several locations along an interior of the outer wall 18, thereby forming interior sidewalls 22*a–d*. The interior wall 20 also may be formed from an open-ended tubular sheet or by another bag attached to several locations along the interior of the outer wall 18. Alternatively, a plurality of sheets or individual strips may be used.

As embodied herein and shown generally in FIG. 1, the interior wall 20 defines a plurality of vertical sections within the outer wall 18. The vertical sections are generally identified by reference letters A–E; however, any number and arrangement of vertical sections may be provided. The vertical sections A–E provide columnar support for holding the bag 10 upright when filled with material. To assist in filling the vertical sections A–E evenly, apertures (not shown) may be formed in the interior wall 20, particularly if the interior wall is formed by another bag, thereby providing communication between the vertical sections A–E.

Figure 4:
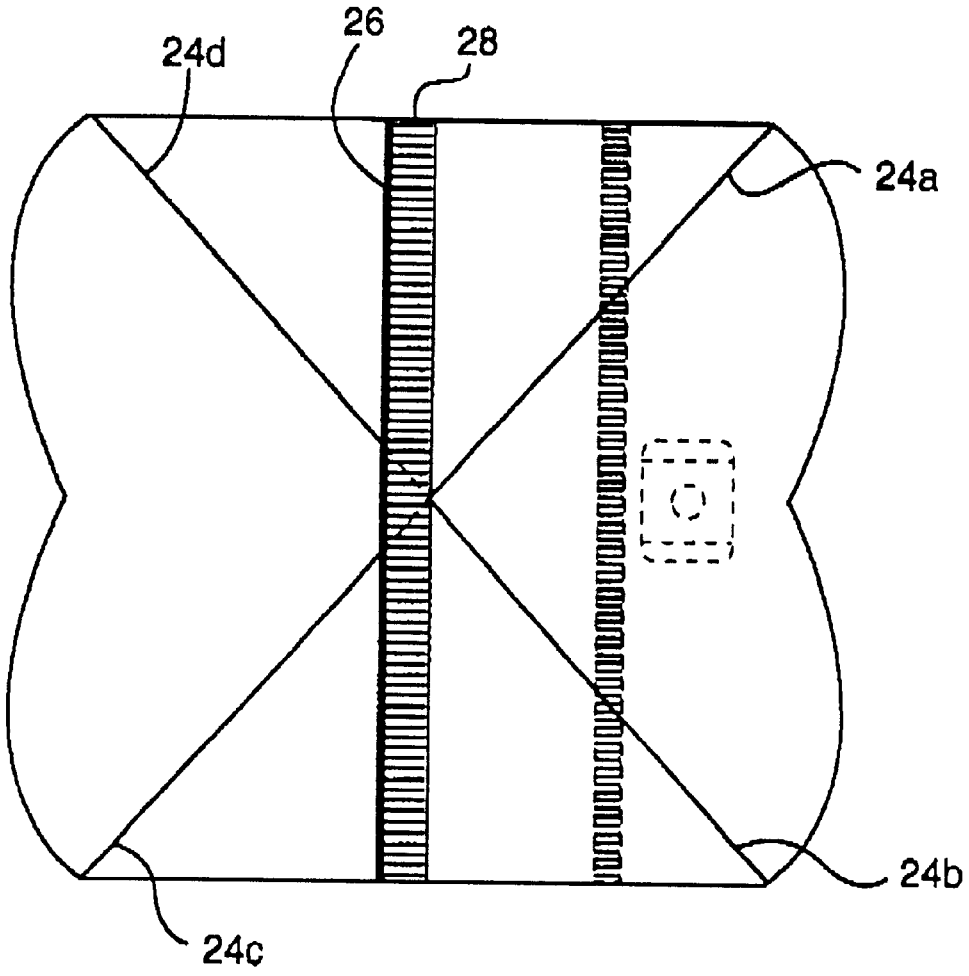
FIG. 4 is a bottom plan view of the bag shown in FIG. 2.

In accordance with the present invention, the bottom portion is closed and flattened so that it provides a substantially planar base. As embodied herein and shown generally in FIG. 4, the bottom portion 14 preferably may be folded along bottom fold lines 24*a–d* so that the bottom portion 14 meets along seal line 26 prior to sealing one or more times, as generally shown by reference numerals 28. Once sealed, the bottom portion 14 defines a substantially planar base 30 along the exterior of the bag, as shown in FIG. 2.

Figure 3:
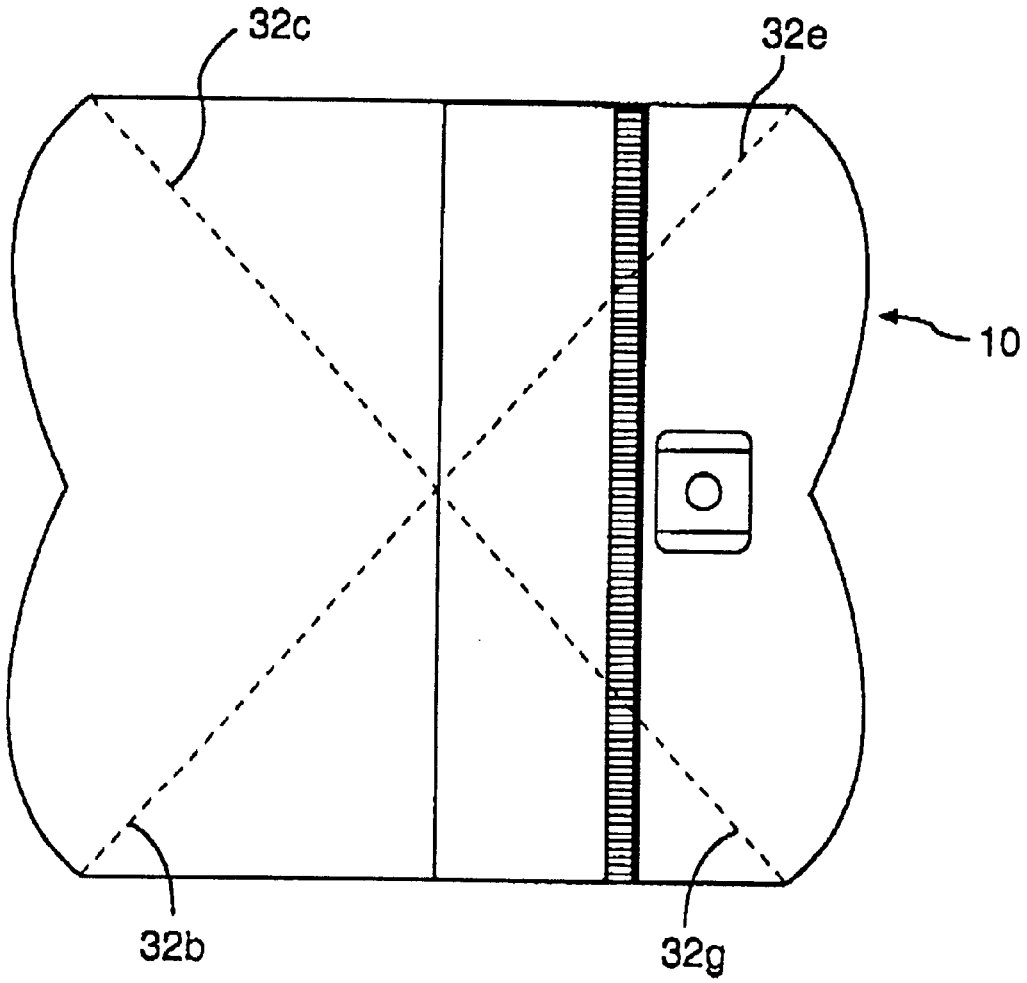
FIG. 3 is a top plan view of the bag shown in FIG. 2.

In accordance with the present invention, the collapsible bag includes a top portion adapted to collapse onto its contents and form a substantially planar top surface to facilitate stacking. As embodied herein and shown generally in FIGS. 1–3, the top portion 16 preferably is folded along fold lines 32*a–h* so that the top end is joined prior to sealing. Preferably, the bag includes one or more top seals 34.

As embodied herein, the top portion defines an interior space F within the bag between the top seal 34 and an imaginary fill line 36. The top portion 16 also includes a vent 38 between the top seal 34 and the fill line 36. It must be appreciated that the fill line 36 may be provided at any number of points along the height of the main body 12 provided that vertical sections are filled sufficiently to provide columnar support for the bag 10.

The vent 38 enables air within the interior space F to be vented to the atmosphere in response to downward pressure on the top portion 16 of the bag 10. Thus, a substantially planar top surface 40 along the fill line, as shown in FIG. 2, is provided after the interior space F is vented to facilitate stacking. Preferably, the vent 38 is a one-way valve which restricts the flow of air into the bag, while enabling air entrained within the interior space to exit the bag, such as the one-way valve sold by Plitek, LLC of Des Plaines, Ill. under the trademark PLITEK, which is affixed to the bag over a preformed hole (not shown). The vent may include other configurations. For example, the vent 38 may comprise one or more apertures along the top portion 16. It also may be a two-way valve. In any case, the vent 38 may be provided during the bag manufacturing process or the bag 10 may be modified at any time accommodate the vent 38, including after the top seal 34 is applied to the bag 10.

Figure 5:
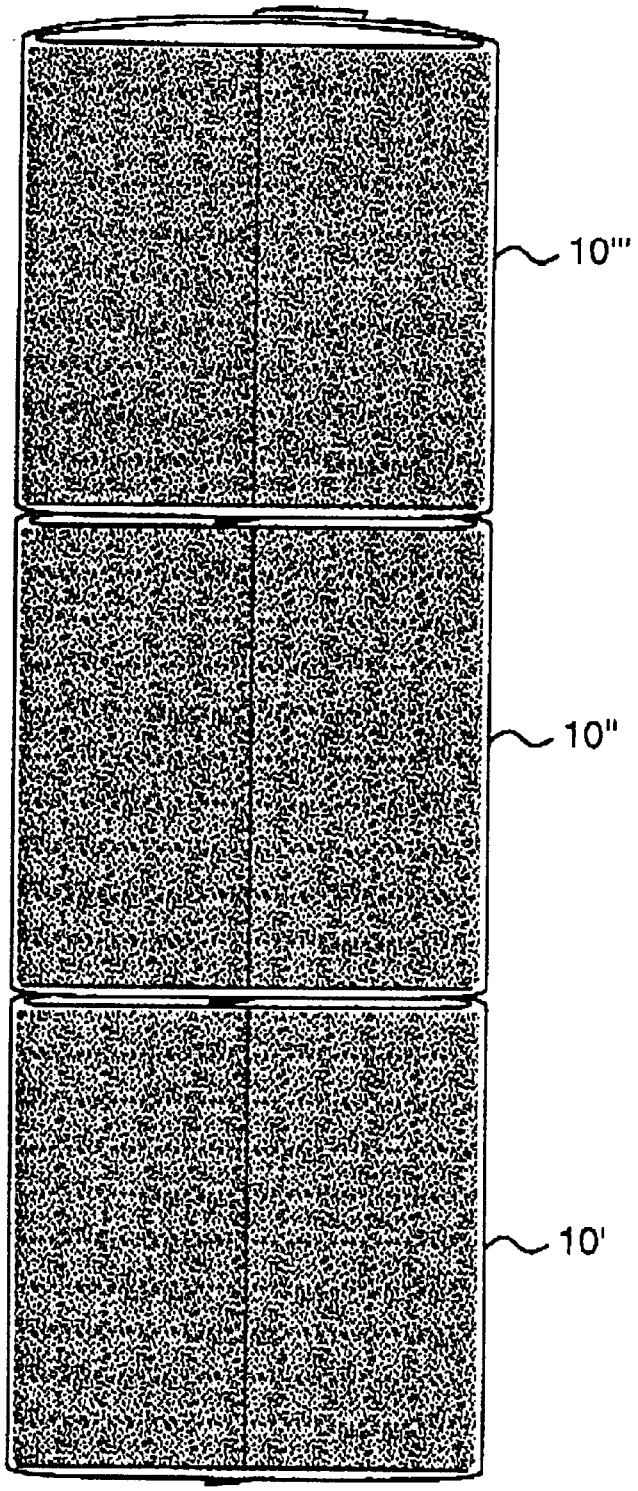
FIG. 5 is a side view of a stacked arrangement of bags of the present invention.

In accordance with the present invention, there also is provided a method of forming collapsible bags for stacking, wherein all of collapsible bags 10 preferably have a configuration similar to those previously described. The method comprises the steps of filling the vertical sections A–E with sufficient material to provide columnar support for holding the bag upright, thereby defining a fill line 36; sealing the top portion 16 along a top seal 34, thus forming an interior space F within the bag between the top seal 34 and the fill line 36; applying or forming a vent 38 along the top portion 16 between the top seal 34 and the fill line 36; compressing the top portion 16 after the sealing step and venting the interior space F to form a substantially planar top surface 40 along the fill line 36; and stacking another bag preferably of the same or similar configuration on the top surface 40. The step of compressing the top portion 16 to vent the interior space F may be done manually or simply by the weight of the bag stacked thereon. Further, an apparatus may be provided to accelerate the compression step. Once completed, the bags may be stacked as shown by the arrangement of bags 10'–10''' in FIG. 5.

Additional advantages and modifications will readily occur to those skilled in the art. The invention in its broadest aspects, is, therefore, not limited to the specific details, representative apparatus and illustrative examples shown and described. Accordingly, departures may be made from such details without departing from the scope of the general inventive concept as defined by the appended claims and their equivalents.

What is claimed is:

1. A method of stacking flowable material in bags comprising:

a) providing collapsible bags each including a main body having an interior wall attached at spaced locations to inside surfaces of the msin body, thereby defining a plurality of vertical compartments, a closed bottom portion having substantially planar base, a top portion extending from the main body at an end opposite said bottom portion, and a vent in the top portion;

b) filling the vertical compartments of one of the collapsible bags with sufficient flowable material to provide columnar support for holding the bag upright, thereby defining a fill line;

c) sealing the top portion along a top seal, so that an interior space is provided within the filled bag between said top seal and said fill line;

d) compressing the top portion after sealing the top portion of the filled bag to vent said interior space through the vent and form a substantially planar top surface along said fill line; and e) stacking another of the collapsible bags, filled by repeating steps b) through d), on the top surface of the filled and vented bag.

2. The method as defined in claim 1, also including a step of folding the top portion of the filling bag along fold lines so that open edges of the filling bag are in abutment prior to sealing.

3. The method as defined in claim 1, also including steps of folding and flattening the top portion of the filling bag in conjunction with the compressing step.

* * * * *

UNITED STATES PATENT AND TRADEMARK OFFICE

CERTIFICATE OF CORRECTION

PATENT NO. : 6,240,709 B1
DATED : June 5, 2001
INVENTOR(S) : Norman Cook

It is certified that error appears in the above-identified patent and that said Letters Patent is hereby corrected as shown below:

Column 4, claim 1,
Line 34, "msin body" should read -- main body --.

Column 4, claim 2,
Lines 55 & 56, "filling bag" should read -- filled bag --.

Column 4, claim 3,
Line 59, "filling bag" should read -- filled bag --.

Signed and Sealed this

Fifteenth Day of January, 2002

*Attest:*

*Attesting Officer*

JAMES E. ROGAN
*Director of the United States Patent and Trademark Office*